US005419226A

United States Patent [19]

Kun

[11] Patent Number: 5,419,226

[45] **Date of Patent: * May 30, 1995**

[54] VIOLIN SHOULDER REST

[75] Inventor: Joseph Kun, Ottawa, Canada

[73] Assignee: The Kun Shoulder Rest, Inc., Ottawa, Canada

[ * ] Notice: The portion of the term of this patent subsequent to Dec. 14, 2010 has been disclaimed.

[21] Appl. No.: 179,187

[22] Filed: Jan. 10, 1994

[51] Int. Cl.[6] ..... G10D 1/02

[52] U.S. Cl. ..... 84/280

[58] Field of Search ..... 84/278, 280

[56] References Cited

U.S. PATENT DOCUMENTS

| | | | |
|---|---|---|---|
| 3,372,614 | 3/1968 | Galster | 84/280 |
| 3,631,754 | 1/1972 | Kun | 84/280 |
| 4,212,222 | 7/1980 | Henkle | 84/278 |
| 4,506,582 | 3/1985 | Goldner | 84/280 |
| 5,208,409 | 5/1993 | Roulet | 84/278 |
| 5,270,474 | 12/1993 | Kun | 84/280 |

FOREIGN PATENT DOCUMENTS

| | | |
|---|---|---|
| 0180069 | 5/1986 | European Pat. Off. . |
| 2443940 | 4/1976 | Germany . |
| 3643225 | 7/1987 | Germany . |

*Primary Examiner*—M. L. Gellner
*Assistant Examiner*—Patrick J. Stanzione
*Attorney, Agent, or Firm*—Stevens, Davis, Miller & Mosher

[57] ABSTRACT

A violin, viola or the like shoulder rest has a firm elongated base (21,81) provided at each end thereof with an upwardly projecting support of a clamping assembly (38–41; 88–90; 96–98) for securement of the shoulder rest to a violin or viola. The supports are firmly held by the base but are foldable such that the clamps (38–41; 88–90; 96–98) are pivoted toward each other and on top of the base (21, 81) into a generally flush arrangement with the top surface (22) of the base to facilitate storage of the shoulder rest when not in use. Two preferred embodiments are dislosed.

4 Claims, 7 Drawing Sheets

VIOLIN SHOULDER REST

BACKGROUND OF THE INVENTION

The present invention relates to a shoulder rest for violins, violas or the like instruments.

Shoulder rests for violins or the like instruments are used to provide comfortable holding of the instrument by a player. Typically, a shoulder rest is secured to a violin to provide a rest surface which engages the player's shoulder while the instrument itself is supported at a selected level depending on the anatomy of the player and in particular on the length of the player's neck.

While many shoulder rests have been proposed and are on the market, the type with a firm base shaped to conform to the player's shoulder is preferred by a substantial percentage of the market. The firm base is usually provided with an underpadding which rests against the user's shoulder when the instrument is being played. Secured to the base at its both ends are upwardly projecting holding members or supports which support pivotable U-shaped ends adapted to engage the side wall of the body of a respective violin near the bottom of the body. My U.S. Pat. No. 3,631,754 or my published international patent application WO 91/05329, both of which are incorporated herein by reference, describe the type of firm base shoulder rests which have enjoyed considerable success in the market.

The term "firm" base of the shoulder rest and the end members designates a structure which, while generally firm, still has a degree of inherent resiliency. The resiliency is utilized in providing a clamping force by which the fork members engage the instrument. This is contrary to a soft, cushion-like base such as described, for instance, in U.S. Pat. No. 4,506,582, where a padding is provided with elastic members at each end of the base, which stretch out to engage the sides of the violin body. These shoulder rests or pads are not too popular. They do not allow adjustability in height and their hold to the instrument is not as firm as in the slightly flexing "firm" base such as described in my patent and patent application mentioned above.

Violin or viola players usually carry the shoulder rests, detached from the violin, in the violin case together with the instrument. The known fully adjustable shoulder rest with a firm base often presents a problem in that it is too large for convenient storage inside the violin case.

SUMMARY OF THE INVENTION

It is an object of the invention to alleviate the above problem and to provide a fully adjustable shoulder rest having a firm base, which—when not in use—could be conveniently folded and thus stored, together with the violin, in a limited space in the violin or the like case, while retaining its full adjustability, firmity and limited resiliency in a fully unfolded state. In other words, the object is to maintain all favoured features, i.e. relative firmness and full adjustability, while also allowing storage in a limited space.

In general terms, the invention provides a shoulder rest for violin or the like musical instrument, comprising, in combination:

(a) an elongated base having a top surface and an undersurface, a first end and a second end, the undersurface being shaped to conform to the shoulder of a person;

(b) a first normally upright support secured to said base near said first end and a second normally upright support secured to the base near said second end;

(c) each support being provided with a pivot stem projecting, in use, upwards relative to said base and having a normally generally upright axis of rotation generally perpendicular to the top surface;

(d) the pivot stem of said first support being provided, at a normally upper end thereof, with a generally U-shaped first clamping member, and the pivot stem of said second support being provided, at a normally upper end thereof, with a generally U-shaped second clamping member, said first and second clamping members being adapted to cooperate with each other to clampingly engage opposed side wall portions of the instrument to firmly but releasably secure the base to the instrument;

(e) each said support further including a folding pivot assembly adapted to allow the folding of the respective support about a fold axis disposed transversely of the base, from a position, where the axis of the respective pivot stem is generally upright, to a folded position downwardly and inwards with respect to the elongation of the base, where the axis of said pivot stem is generally parallel with said top surface and where the U-shaped clamping members and both generally flush with the top surface and are disposed between the fold axes.

The shoulder rest also includes stop means limiting the pivoting movement of each support to about 90°, from the folded position, where the support is disposed on said top surface, to a generally upright position, where the support projects away from the top surface, thus providing the shoulder rest with the firmness required for a firm clamping of the U-shaped members on the sides of the violin body where in use.

The invention will now be described by way of two preferred embodiment. Those skilled in the art will understand that various sizes of the shoulder rest exist. Such different sizes are suitable not only for different sizes of violins but also for other similar instruments such as viola. Therefore, the term "violin" is used for convenience only and does encompass other instruments such as a viola.

BRIEF DESCRIPTION OF THE DRAWINGS

The invention is described with reference to the accompanying diagrammatic drawings, wherein.

DETAILED DESCRIPTION OF PREFERRED EMBODIMENTS

Figure 1:
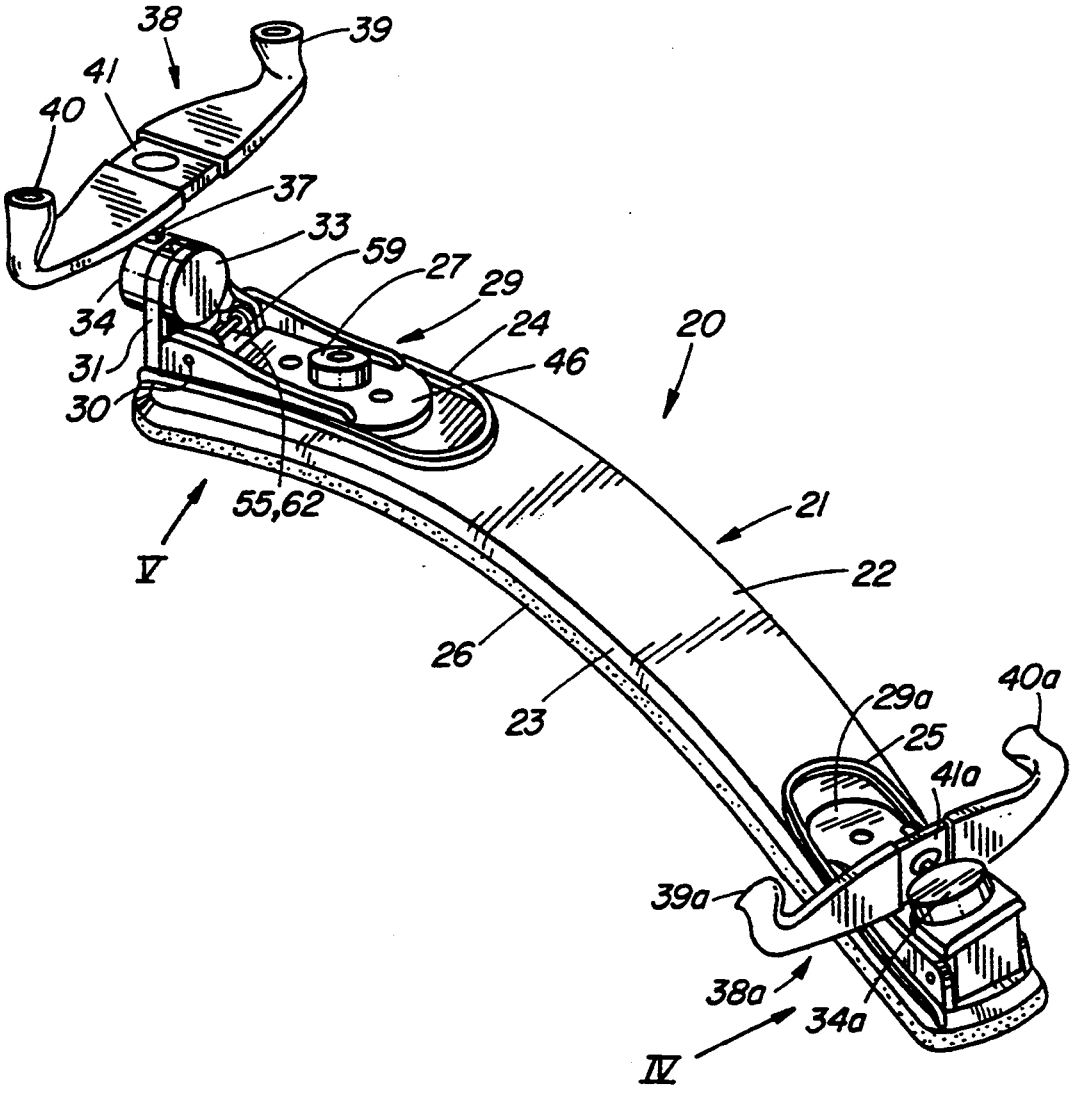
FIG. 1 is a perspective view of a shoulder rest including the features of the present invention, one end being shown in an unfolded, operative state, ready to be clamped onto a violin, the other end being shown in a folded state.

Turning now to the embodiment of FIGS. 1–8, the shoulder rest 20 of the present invention comprises an elongated base 21. The base 21 has a top surface 22. The top surface 22 is one face of an injection moulded, generally firm plate 23 shaped to conform to the shoulder of the user of the violin. The plate 23 is injection moulded from a mixture of glass fibre and nylon. Two U-shaped ribs 24, 25 integral with the plate 23 project from the top surface 22. Each rib 24, 25 is located at one end of the base 21. The ribs provide an end reinforcement of the base and a guidance for end members of the shoulder rest, as will be described. Adhered to the underside of the plate 23 is a layer 26 of a polyurethane foam padding. The downwardly facing surface of the padding follows the shape of the plate 23 and is thus likewise conformed to the shoulder of a user.

Fixedly secured to the top surface 22 by a nut 27 threaded on a stem 28 is a longitudinal arm 29. Hingedly secured to the longitudinal arm 29, for pivotal movement about a pivot pin 30, is an upright portion or support 31. The pivotal securement will later be described in detail.

The upright portion or support 31 carries a disk-shaped member 32. The disk-shaped member 32 is comprised of an inner disk 33, an outer disk 34 and an intermediate pivot 35 integral with the two. The pivot 35 is received at the bottom end of an upright slot 36. The outer disk 34 is provided with a radial threaded passage which is compatible with an upwardly projecting, threaded stem 37. It can be seen from FIG. 1 that, in the unfolded state, the threaded stem 37 is generally at right angles to the top surface 22. The upper end of the pivot stem 37 is fixedly secured to and thus carries a U-shaped clamping member 38 which includes two clamping fingers 39, 40 and a generally horizontal root portion 41 integral with the fingers 39, 40 and forming the base of the "U" of said clamping member 38.

The right-hand end of the base 11 is provided with an assembly the function and the general structure of which is virtually identical with that described above. It is therefore designated with the same reference numerals indexed with a letter "a". For instance, the longitudinal arm 29*a* corresponds to the longitudinal arm 29 even though they differ in detail, such as the shape of the undersides 42, 42*a*, which are one concave (42) and the other convex (42*a*) in conformity with the shape of the top surface 22 at the respective ends of the base 21.

The mutual arrangement of the elements is well known and does not have to be described in greater detail. Each upright portion or support 31, 31*a* and the respective disk-shaped member 32, 32*a* with all its elements described is cumulatively referred to as "a generally upright support" since that is the position it assumes when the shoulder rest is in use, as shown at the left-hand side of FIG. 1.

Figure 2:
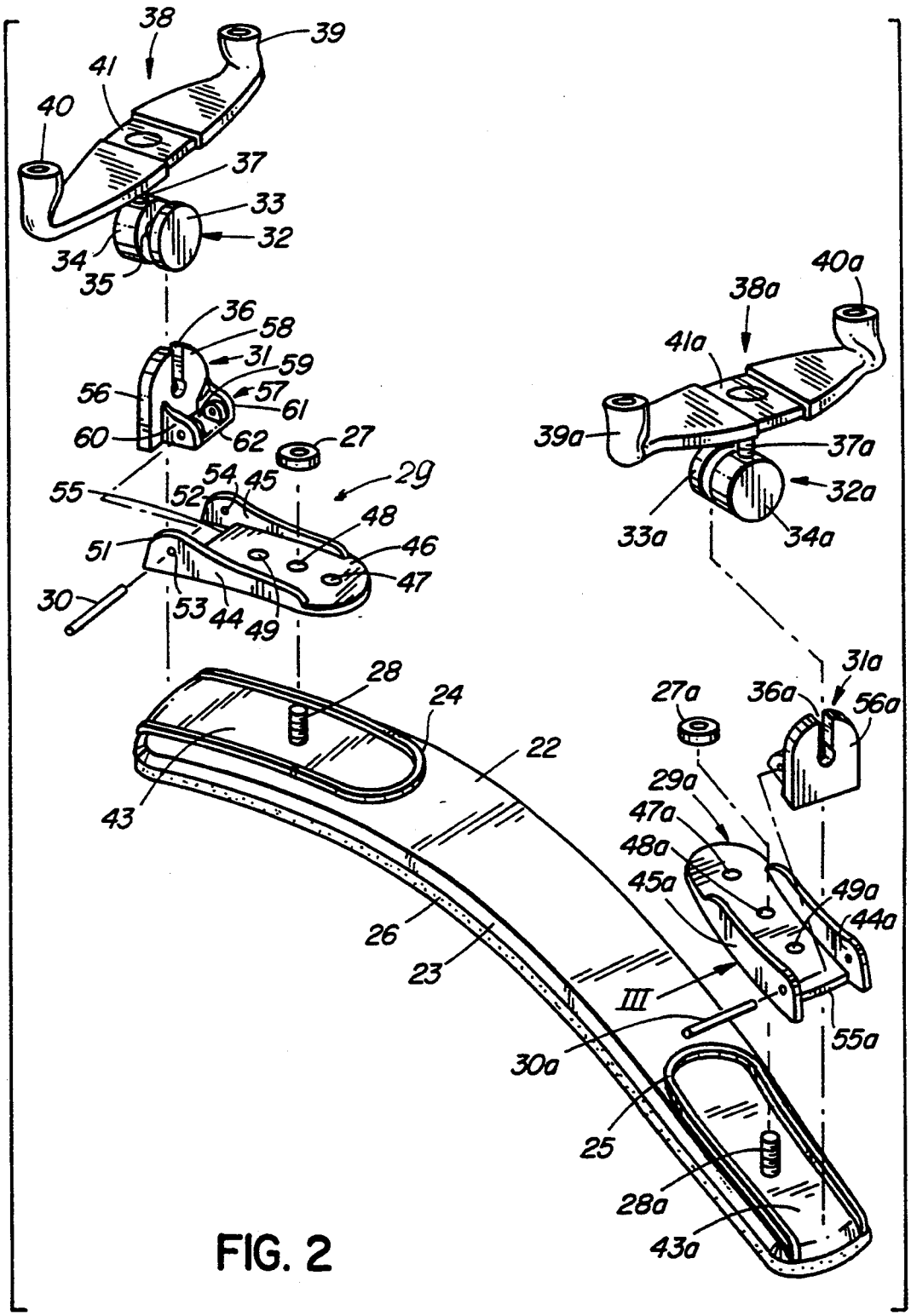
FIG. 2 is an exploded perspective view of the shoulder rest of FIG. 1 showing both end members in an unfolded state.
Figure 3:
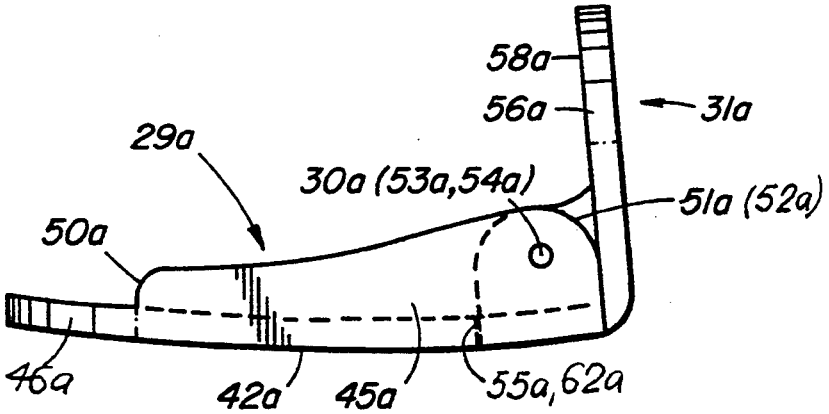
FIG. 3 is an enlarged side view of one end member of the shoulder rest of FIG. 1, the end member being shown in the unfolded state corresponding to the assembled state viewed in the direction III of FIG. 2.
Figure 4:
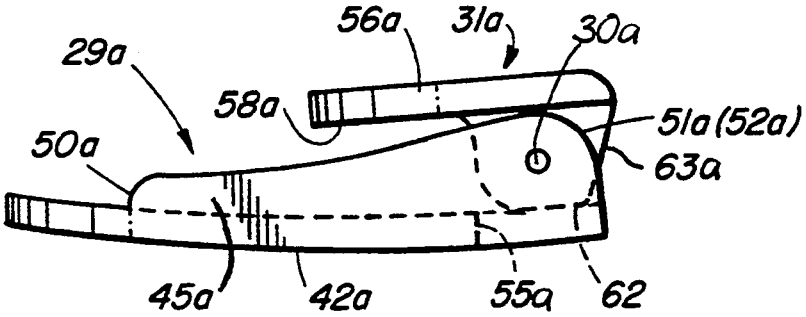
FIG. 4 is a view similar to that of FIG. 3 but showing the end member in a folded or collapsed state, corresponding to the view in the direction IV of FIG. 1.
Figure 5:
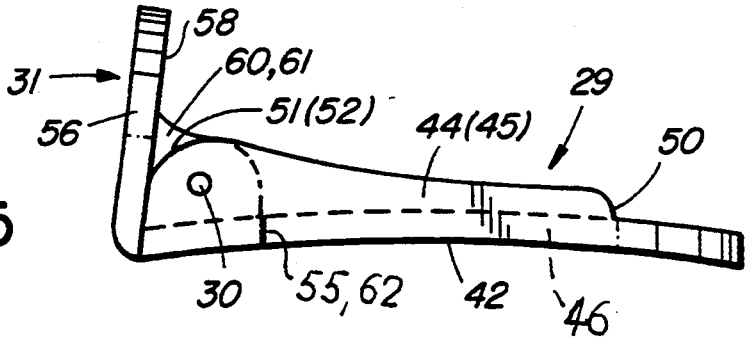
FIG. 5 is an enlarged side view of the other end member of the shoulder rest, generally as viewed in the direction V of FIG. 1.
Figure 6:
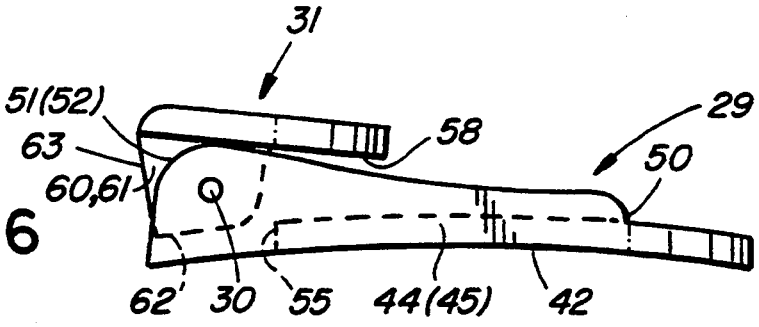
FIG. 6 is a view similar to that of FIG. 5 but showing the end member in a collapsed state.

Referring now particularly to FIGS. 2, 5 and 6, the underside 42 of the longitudinal arm 29 is slightly concavely curved as best seen in FIGS. 5 and 6, to conform to the slightly convex inner section 43 of the top surface 22 of the base 21. The arm 29 is channel shaped and has two opposed side flanges 44, 45 interconnected by an integral web 46 which provides the concave curvature at the underside 42. The web 46 has a number of openings 47, 48, 49.

As best seen from FIGS. 5 and 6, The flanges 44, 45 (only flange 44 being visible but having a generally identical contour as flange 45) have a rounded contour which merges with the contour of the top face of the web 46 at the front end 50 of the flange 44, 45. The height of the flanges 44, 45 gradually increases in the direction away from the respective end of the base 21, to reach a rear radius section 51, 52. The rear radius sections 51, 52 are provided with coaxial openings 53, 54 compatible with the pivot pin 30.

The radius of the rear sections 51, 52, 51*a*, 52*a* is so designed that, in a fully erected position of FIG. 5, the inner surface 58 firmly abuts against the rear end of the flange 44, 45. When it is desired to fold the support 31 (i.e. the plate 56 or 56*a*), the radius at 51, 51 provides a slight camming effect which however can be overcome but which nevertheless assists in providing a resilient locking effect holding the plate 56 and its associated parts in a folded position.

It will be noted from FIG. 2 that the rear ends of the flanges 44, 45 extend beyond the rear edge 55 of the web 46.

The longitudinal arm 29 is an integral piece injection moulded from a mixture of nylon and glass fiber. The support 31 is likewise an integral, injection moulded piece made from the same or similar mixture.

The support 31 comprises a normally (i.e. in an unfolded state) generally upright plate section 56 in which the upright slot 36 is provided. A channel shaped bracket 57 projects from an inner surface 58. The bracket 57 has a web section and two side flange sections 60, 61 provided with coaxial passages for the pivot pin 30. The spacing between the side flange sections 60, 61 is small enough to allow the placement of same between the inside faces of the side flanges 44, 45 of the longitudinal arm 29. The web portion 59 defines a front edge 62. In a fully unfolded state, the front edge 62 abuts against the rear edge 55. Thus the edges 62, 55 form one embodiment of stop means for limiting the movement of the support 31 from a folded position (right hand side of FIG. 1, FIGS. 4 and 6) to an unfolded positions (left hand side of FIG. 1, FIG. 3, FIG. 5), beyond which the support 31 and thus the clamping members 38 cannot move. Another stop means serving the same general purpose is the abutment of the underside 63 of the web section 59 against a convex section 43 of the top surface 22, within the boundaries of the U-shaped rib 24. The underside 63*a* of the opposite web section 59*a*, of course likewise engages the concave section 43*a*.

The abutment of the edges 55, 62 and the engagement of the undersides 63, 63*a* with the respective sections of the top surface 22 form an important feature of the embodiment of the invention shown. They secure the strength of the overall structure when in fully open state.

Turning now to the second embodiment shown in FIGS. 9–14. This is a modification of a shoulder rest also described in the above patent and patent application and known on the market under the trade name "The Kun Super Rest".

The elongated base 81 is comprised of a plate 82 injection molded from a suitable material, in the embodiment shown, from a mixture of glass fibres and nylon, to secure a generally firm nature of the base allowing only a limited resiliency. As in the first embodiment, the underside of the plate 82 is provided with a polyurethane foam padding 83. The plate 82 and the padding 83 are formed in accordance with the rounding of human shoulder to provide comfortable hold of the instrument.

Figure 9:
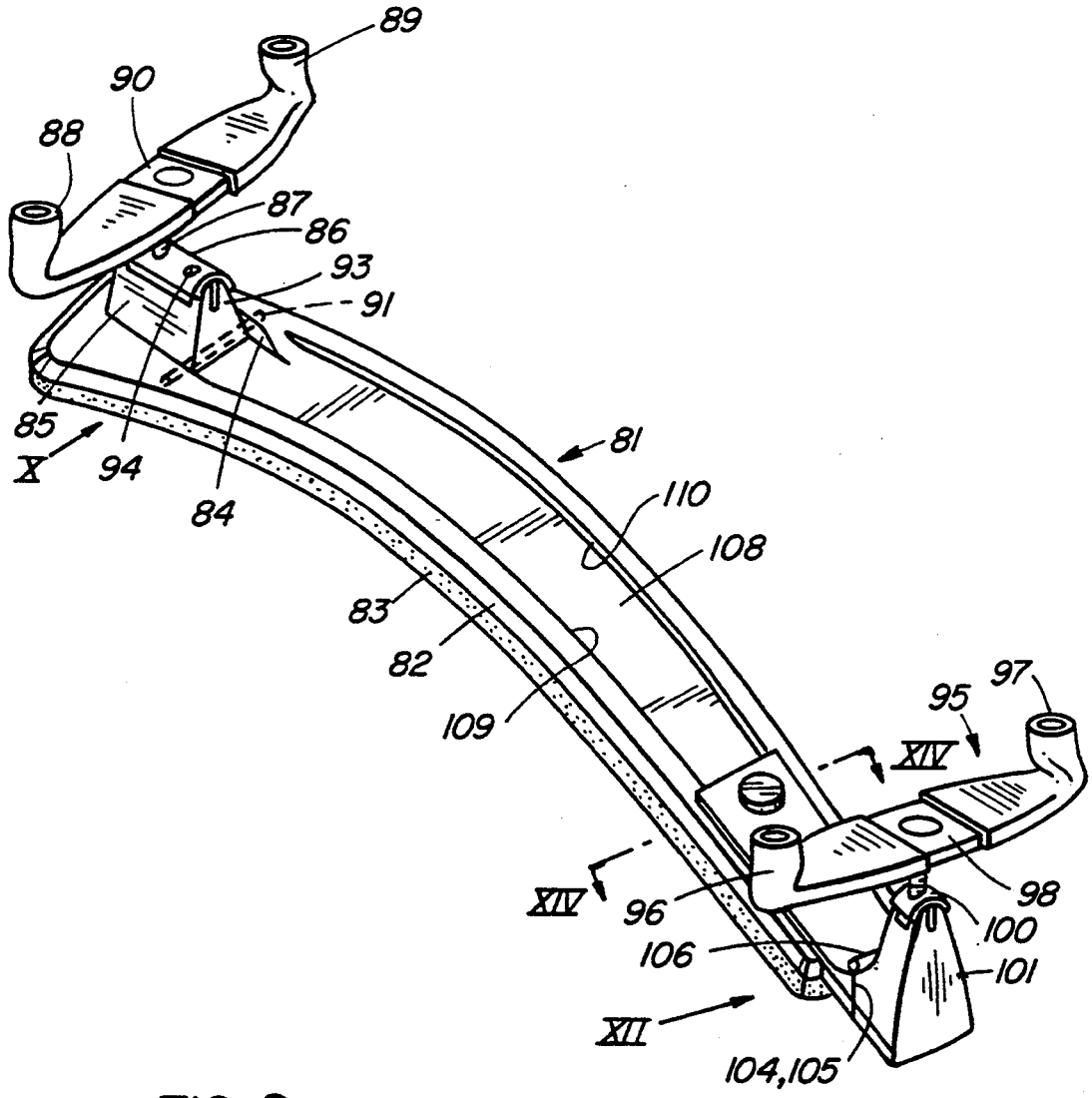
FIG. 9 is a perspective view similar to that of FIG. 1 but showing another embodiment of a shoulder rest including the features of the present invention, the shoulder rest being in a fully unfolded state.

The remote end of the plate 82 as viewed in FIG. 9 is provided with a shallow, rectangular recess 84. Seated in the recess 84 is a frustopyramidal block or support 85 so named because it supports the clamping member assembly threaded in a transversely tiltable member 86. As in the first embodiment, the clamping assembly includes an upwardly projecting, threaded stem 87. In the unfolded state, the threaded stem 87 is generally at right angles to the top surface of the base 81. The upper end of the pivot stem 87 is fixedly secured to and thus carries a U-shaped clamping member which includes two clamping fingers 88, 89 and a generally horizontal root portion 90 integral with the fingers 88, 89 and forming the base of the "U" of said clamping member. The arrangement of the clamping member in respect of the support 85 is the same as that of the corresponding parts in the first embodiment and therefore does not have to be described in detail.

Figure 10:
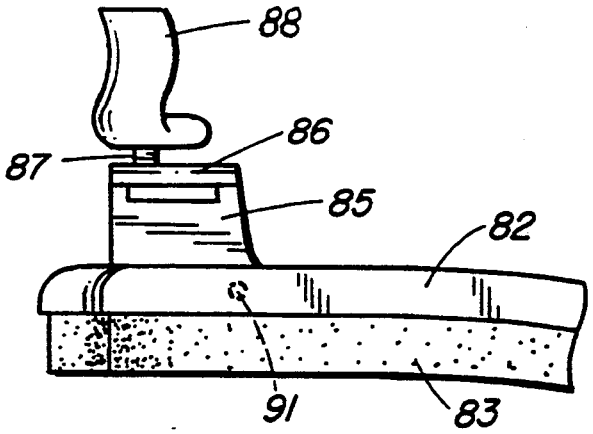
FIG. 10 is a simplified partial view of the shoulder rest as shown in FIG. 9 taken in the direction X of FIG. 9, showing a support member at one end of the base of the shoulder rest.
Figure 11:
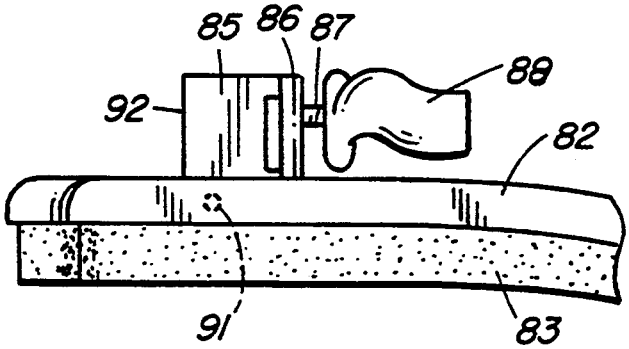
FIG. 11 is a view similar to that of FIG. 10 but showing the support member in a collapsed state.

The support 85 is pivotally secured to the plate 82 at a pivot pin 91 which is embedded in the material of the plate 82 and extends generally transversely of the elongated plate 82. Note that the views of FIGS. 10 and 11 are taken in a direction parallel with the axis of the pin 82. In the fully unfolded state, the support 85 rests with the undersurface 92 (FIG. 11) on the bottom of the recess 84. In a folded position (FIG. 11), the support 85 is turned about 90° clock-wise from the position of FIG. 10, whereby a front face portion 93 of the support 85 rests on the top surface of the plate 82. In general terms, therefore the arrangement can be defined as having a folding pivot 91 which connects a lower inside portion (i.e. lower end of the front face portion 93) of the support 85 to the base 81.

It will be noted that the support 85 has a fixed position longitudinally of the base 81. The only adjustment of the distance of the clamping member 88–90 with respect to the opposed clamping member at the other end of the base 81 can be attained by threading the stem 87 in one of two openings 94 in the tiltable member 86. In the embodiment depicted in FIG. 9, the clamping member 88–90 is in a an extreme outer position. Threading the stem 87 into the forward opening 94 would result in a reduced distance from the opposed clamp.

Figure 7:
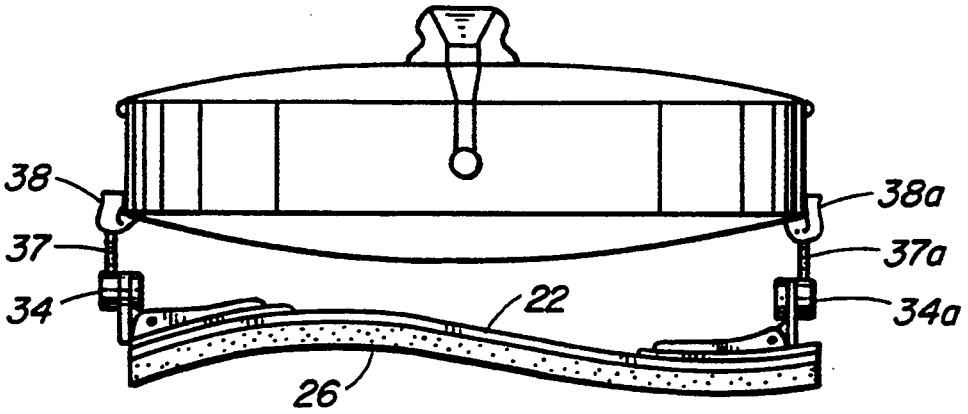
FIG. 7 is a diagrammatic end view of a violin with the shoulder rest applied to the body of the violin.

On the other hand, the position of the opposed clamping member 95 along the base 81 can be adjusted over a more substantial and practically infinitely fine range. The clamping member 95 is of a structure identical with that of the clamping member 88–90. It has a pair of opposed clamping fingers 96, 97 and a root portion 98 integral with the former two and forming the base of the U-shape of the clamp 95. A threaded stem 99 is fixedly secured to the clamp 95. It is threadably received in a transversely tiltable member 100 which is mounted on top of a support 101. The support 101 is hingedly secured to one end of a longitudinal sliding plate 102. The sliding plate has a boss 103 at the extreme outer end thereof. The boss 103 forms a smooth transition between the support 101 and the plate 102 when the shoulder rest is in an unfolded position. At its outer extreme, the boss 103 defines a generally planar slanted abutments surface 104 which is compatible with a planar second abutment surface 105 at the front portion of the support 101. The support 101 can thus assume an upright position (FIG. 12) and a folded position (FIG. 13), with the abutment surfaces 104, 105 providing stop means for preventing the pivotal movement of the support 101 about a pivot pin beyond the fully unfolded or upright state, where the clamp 95 is ready to engage the body of a violin as shown in FIG. 7.

Figure 12:
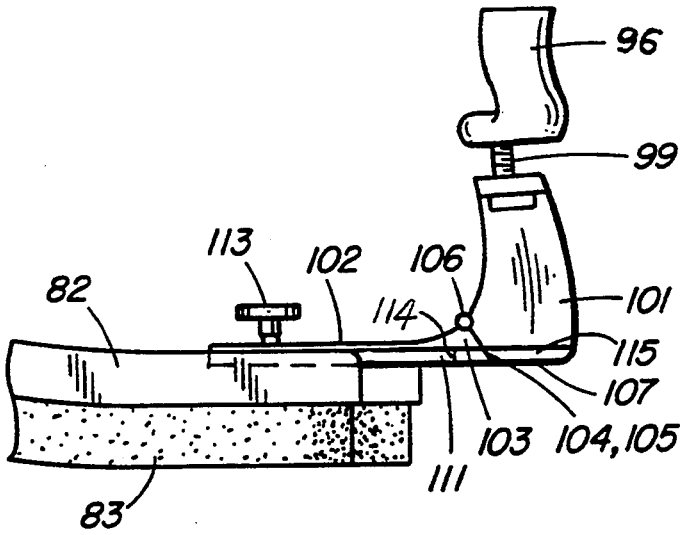
FIG. 12 is a view of the other end of the shoulder rest of FIG. 9, taken in the direction XII of FIG. 9.

In the arrangement of FIG. 12, the abutment surfaces 104, 105 are the only stop means for the purpose set forth. However, if the shoulder rest is to be used with a smaller size violin, the plate 102 and with it the support 101 can be slidably moved along the base 81 toward the opposite clamp 88–90, whereby the underside 107 would rest on the surface of the plate 82, inside a wide groove 108 in the top surface of the plate 82. This would provide additional stop means for the purpose set forth.

Figure 14:
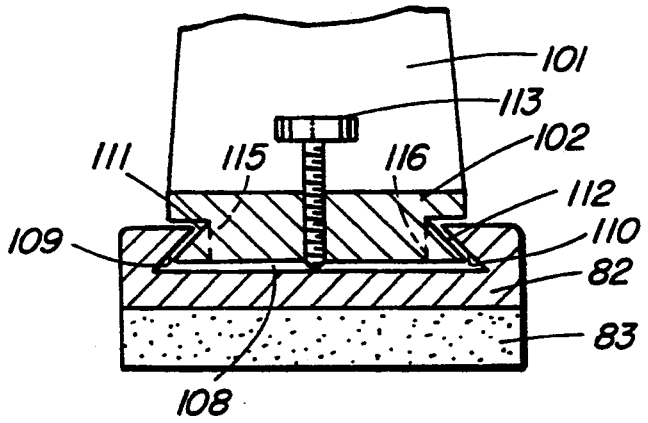
FIG. 14 is a simplified, diagrammatic cross section XIV—XIV of FIG. 9

For this purpose, referring to FIG. 14, the groove 108 and the plate 102 are formed to provide a sliding dovetail joint. The groove 108 has inwardly facing sloping side walls 109, 110, while the side edges 111, 112 of the plate 102 have a correspondingly outwardly facing sloping configuration. A setscrew 113 threaded in the plate 102 engages with its lower end the bottom of the groove 108, pressing the edges 111, 112 against the side walls 109, 110 locking the plate (and thus the entire assembly up to the clamping member 95) at a desired location longitudinal of the base 81.

The dovetail edges 111, 112 extend along the plate only to an outer limit 114 beyond which their shape is changed to a rectangular configuration at which each edge is at right angles to the top surface of the base 81. Such modified edges 115, 116 are shown in broken lines of FIG. 14. The modified edge portion extends from the end of the box 103 on to the end of the underside 107 of the support 101. This arrangement allows the tilting of the support 101 into a folded position even when the plate is placed to a position where the underside 107 is within the groove 108 of the base 81.

Figure 13:
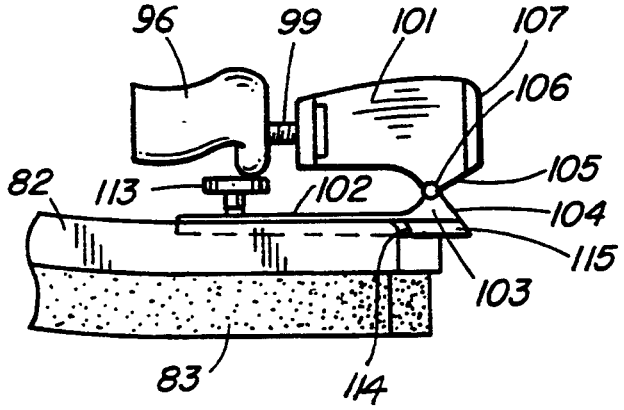
FIG. 13 is a view similar to that of FIG. 12 but showing the end member in a collapsed state.

Regardless of the instant position of the underside of the support 101, it can be seen that stop means are provided which effectively prevent the pivoting of the support 101 from the folded state of FIG. 13 beyond the upright position of FIG. 12, where the support is firmly connected with the base to transform a limited flexing of the base 81 into a clamping force for securement of the shoulder rest to a violin as shown in FIG. 7. At the same time, on detachment of the shoulder rest from a violin, both supports 85, 101 can be easily folded (FIGS. 11, 13) to facilitate storage of the shoulder rest.

Figure 8:
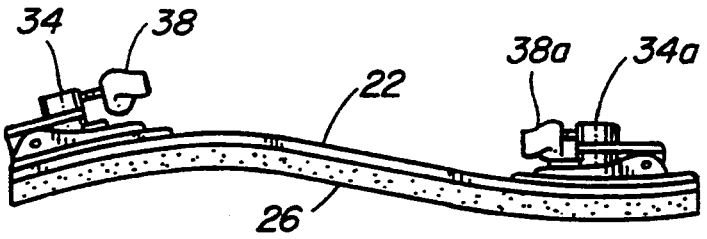
FIG. 8 is a diagrammatic view of the shoulder rest of FIG. 7 shown in a folded state.

In use, and referring to the first embodiment shown in FIGS. 1–8, the shoulder rest in the unfolded state is ready to be applied to a violin as shown in FIG. 7. The pivot means 30, 53, 54 and the stop means 55, 62, 63, 43 which limit the "opening" of the supports 31, 31*a* render the entire assembly firm and only capable of a limited resiliency sufficient to provide the clamping hold as shown in FIG. 7. Thus, all functions of my previous design of the shoulder rest are maintained, inclusive of the possibility of adjusting the distance between the clamping members 38, 38*a* by selecting the appropriate hole 47, 48, 49 in the arm 18 for engagement with the screw 28 projecting from the base 21. Also, the pivotal self-centering effect at the clamping members 38, 38*a* due to the threaded engagement between the stems 37, 37*a* in the outer disk 34, 34*a* is secured. The possibility of a limited adjustment of transverse inclination of the clamps 38, 38*a* by pivoting the disk shaped members 32, 32*a* relative to the supports 31, 31*a* is also maintained. In addition, the important feature is provided of the folding-down to a collapsed state to reduce the space required for storage, as best seen in FIG. 8.

The operation of the second embodiment is analogical and does not require any more details to those already given. The folded state of the supports 85, 101 is shown in FIGS. 11, 13, while the unfolded state is shown in FIGS. 10 and 12.

While the present invention has been described by way of two preferred embodiments as used on my previous designs of the shoulder rest, it is to be understood that the invention can also be used in other embodiments, different from the above disclosure, without departing from the scope of the present invention. Accordingly I wish to protect by letters patent which may issue on this application all such embodiments as fairly fall within the scope of my contribution to the art.

I claim:

1. A shoulder rest for violin or the like musical instrument, comprising, in combination:

(a) an elongated, generally firm base having a top surface and an undersurface, a first end and a second end, the undersurface being shaped in conformity to the shoulder of a person;

(b) a first normally upright support secured to said base near said first end and a second normally upright support secured to the base near said second end;

(c) each support being provided with a pivot stem projecting, in use, upwards relative to said base and having a normally generally upright axis of rotation generally perpendicular to the top surface;

(d) the pivot stem of said first support being provided, at a normally upper end thereof, with a generally U-shaped first clamping member, and the pivot stem of said second support being provided, at a normally upper end thereof, with a generally U-shaped second clamping member, said first and second clamping members being adapted to cooperate with each other to clampingly engage opposed side wall portions of the instrument to firmly but releasably secure the base to the instrument;

(e) each said support further including a folding pivot assembly adapted to allow the folding of the respective support about a fold axis disposed transversely of the base, from a position, where the axis of the respective pivot stem is generally upright, to a folded position downwardly and inwards with respect to the elongation of the base, where the axis of said pivot stem is generally parallel with said top surface and where the U-shaped clamping members are both generally flush with the top surface and are disposed between the fold axes.

2. The shoulder rest of claim 1, wherein the folding pivot connects a lower inside portion of the respective support to the base, whereby the folding of the supports is effected downwardly and inwards with respect to elongation of the base.

3. The shoulder rest of claim 1, wherein the folding pivot connects a lower inside portion of the respective support to a longitudinal arm, the shoulder rest comprising means for securing the longitudinal arm to said elongated base at a number of selectively adjustable positions longitudinally of the base, whereby the position of the folding pivot relative to the base is selectively adjustable.

4. The shoulder rest of claim 1, including stop means limiting the movement of the folding pivot to about 90°, from the folded position in which the respective pivot stem is generally parallel with elongation of said base, to an unfolded position in which the respective pivot stem is generally perpendicular to the top surface and to the elongation of said base.

* * * * *